United States Patent [19]

Allen

[11] 3,951,102

[45] Apr. 20, 1976

[54] ROLLER COATING APPARATUS

[75] Inventor: Roger Anthony Allen, Prestwood, Gt. Missenden, England

[73] Assignee: Wiggins Teape Research & Development Limited, London, England

[22] Filed: Nov. 15, 1973

[21] Appl. No.: 416,083

[30] Foreign Application Priority Data

Nov. 27, 1972 United Kingdom ..... 54620/72

[52] U.S. Cl. ..... 118/249; 118/262

[51] Int. Cl.[2] ..... B05C 1/08

[58] Field of Search ..... 118/249, 212, 250, 262; 117/111

[56] References Cited

UNITED STATES PATENTS

| | | | |
|---|---|---|---|
| 2,293,691 | 8/1942 | Harrigan | 118/249 |
| 2,631,643 | 3/1953 | Schueler | 118/262 X |
| 2,681,636 | 6/1954 | Fridolph | 118/249 |
| 3,647,525 | 3/1972 | Dahlgren | 118/262 X |
| 3,663,359 | 5/1972 | Braim | 118/262 X |

*Primary Examiner*—John P. McIntosh

*Attorney, Agent, or Firm*—Burns, Doane, Swecker & Mathis

[57] ABSTRACT

In coating apparatus of the kind in which a roll dips into a bath of liquid coating material and applies the material to a transfer roll which in turn transfers the material to an applicator arranged to apply the material to a web passing between the applicator roll and a backing roll the applicator roll is independently rotated in the same direction as the transfer roll and the backing roll is rotated in the same direction as the applicator roll.

1 Claim, 1 Drawing Figure

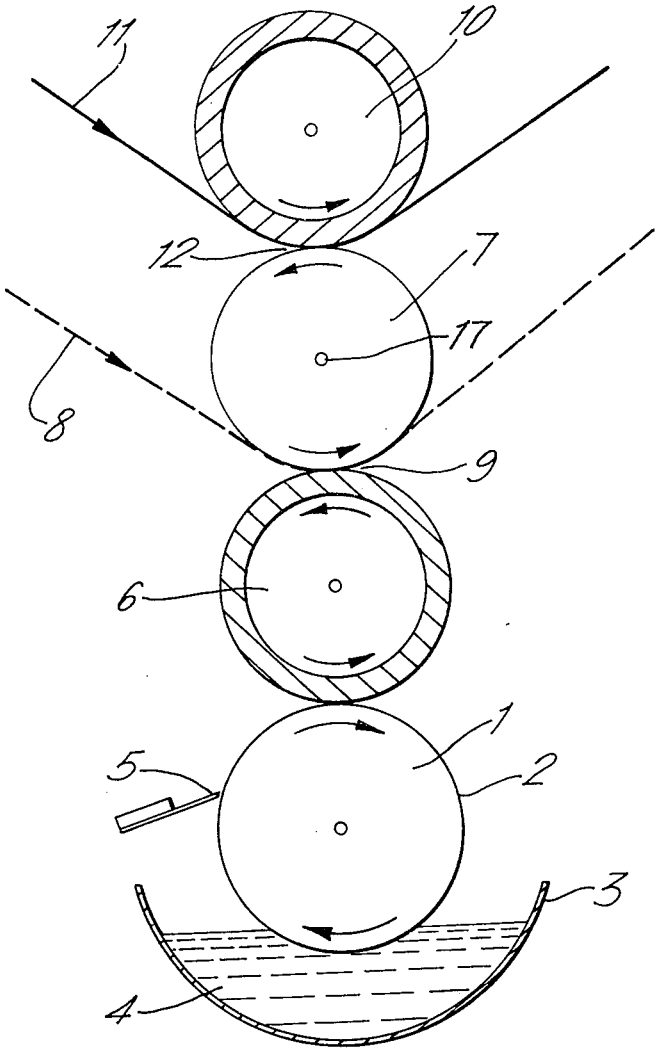
11
10
12
7
17
8
9
6
1
5
2
3
4

ROLLER COATING APPARATUS

BACKGROUND OF THE INVENTION

1. Field of the Invention

This invention relates to apparatus for applying a coating to a web of material, and particularly to apparatus for applying a coating to a paper web.

2. Description of the Prior Art

Various methods of applying a coating to a moving web of material, for example a web of paper, are well known, including air-knife coating methods, blade coating methods, and forward or reverse roll coating methods, each of these methods requiring particular apparatus.

When it is required to apply a low weight coating to a moving web of material, for example a coating of less than 10 g/m$^2$, a gravure coating method is often used, in which method the coating material to be applied is transferred onto the surface of the moving web of material from cells or depressions in the surface of a gravure roll over which the moving web of material passes and which is rotated in the direction of movement of the web of material.

A disadvantage of the simple gravure coating method mentioned above, in which the web of material to be coated is in direct contact with the gravure roll, is that it is difficult to control the weight of coating applied.

In order to overcome this disadvantage it is known to use so-called off-set gravure coating apparatus in which a second, applicator roll which is rotated by contact with the gravure roll in the opposite direction to the gravure roll, is interposed between the gravure roll and the web of material. With such apparatus the coating material to be applied is transferred from the gravure roll to the applicator roll and then from the applicator roll to the web of material which moves against the direction of rotation of the applicator roll. However, while such apparatus enables the weight of the coating applied to the web of material to be better controlled than is possible with simple gravure coating apparatus, nevertheless such apparatus has the disadvantage that it can be used to apply only a limited range of coating weights.

This is because both the weight of coating applied to the web of material and the quality of the applied coating, i.e. the evenness of the applied coating, are dependent upon the speed of rotation of the applicator roll. However, with regard to the weight of the applied coating, the possible speed of rotation of the applicator roll is determined by the normally predetermined speed of rotation of the gravure roll, whereas with regard to the quality of the applied coating, the desired speed of rotation of the applicator roll is determined by the ratio between the normally predetermined speed of the web of material over the applicator roll and the speed of rotation of the applicator roll. This latter relationship is of particular importance since at ratios outside certain limits the coating material is not evenly transferred to the web of material being coated.

Thus, the desired speed of rotation for the applicator roll for any coating operation is dependent upon two independent and possibly incompatible parameters, i.e. the speed of movement of the web of material being coated, and the speed of rotation of the gravure rolls, and thus it is not always possible to obtain an even coating at a desired coating weight.

This major disadvantage of known gravure coating apparatus is also a disadvantage of all other known coating apparatus in which the speed of rotation of an applicator roll cannot be altered, for example in order to obtain an even coating, independently of a change in the weight of the applied coating.

SUMMARY

According to this invention there is provided apparatus for applying a coating to a web of material, comprising means to apply a predetermined amount of a liquid coating material to a transfer roll; an independently driven applicator roll mounted for rotation in contact with and in the same direction as the transfer roll; and a backing roll mounted for rotation in the same direction as the applicator roll, the applicator roll and the backing roll together forming a nip through which a web of material to be coated with the coating material is, in use, passed.

In use of apparatus according to this invention liquid coating material applied to the transfer roll is transferred to the applicator roll by the transfer roll, and then applied by the applicator roll to a web of material passing through the nip formed between the applicator and backing rolls.

The means to apply a predetermined amount of a liquid coating material to the transfer roll can be, for example, a blade acting directly on the transfer roll which is arranged to pick-up the coating material from a bath thereof; a metering roll arranged to be rotated adjacent the transfer roll but at a redetermined spacing therefrom; or, in particular, a gravure roll which is arranged to pick-up the coating material from a bath thereof.

Thus, with the apparatus according to this invention including a gravure roll, the weight of the coating applied to the web of material can be controlled by control of the speed of rotation of the gravure and transfer rolls, and the evenness of the applied coating is dependent upon the speed of rotation of the independently driven applicator roll, which speed is not directly determined by the speed of rotation of the transfer roll. The apparatus can therefore be used to apply an even coating at any desired coating weight.

As previously mentioned gravure coating methods are normally used when it is required to apply a relatively low weight coating, and the apparatus of this invention is particularly suitable for the application of such coating.

BRIEF DESCRIPTION OF THE DRAWING

Th drawing shows a diagrammatic side elevation of coating apparatus according to the invention.

DESCRIPTION OF THE PREFERRED EMBODIMENT

The apparatus shown in the drawing comprises a gravure roll 1 having a recessed surface 2 which dips into a bath 3 of a liquid coating material 4. A doctor blade 5 is arranged to remove excess coating material 4 picked-up by the roll 1 from the bath 3.

Arranged parallel to and in contact with the roll 1 is a rubber-covered, transfer roll 6 which, as indicated by the arrows shown on the rolls, in use is rotated by the roll 1 in the opposite direction to the roll 1, and to which the coating material 4 picked-up by the roll 1 is transferred.

Arranged parallel to and in contact with the roll 6 is an applicator roll 7 which, as indicated by the arrow shown thereon, is in use independently driven to rotate in the same direction as the roll 6.

If, as indicated by the dashed line 8, a web of material was passed through the nip 9 formed by the rolls 6 and 7, the apparatus so far described would constitute a conventional off-set gravure coating apparatus having the inherent limitations discussed above, the roll 6 constituting an applicator roll, and the roll 7 constituting a backing roll.

However, the apparatus of this invention shown in the drawing includes a fourth, rubber-covered, backing roll 10 which is arranged parallel to the roll 7, and a web of material 11 to be coated is passed through a nip 12 formed between the rolls 7 and 10. As indicated by the arrow thereon the roll 10 is rotated in the same direction as the rolls 6 and 7.

In use of the above described apparatus, coating material 4 is picked-up from the bath 3 by the gravure roll 1, and is then transferred from the gravure roll 1 to the applicator roll 7 by the transfer roll 6. The transferred coating material is then applied to the web of material 11 at the nip 12 between the applicator roll 7 and the backing roll 10.

In such operation the weight of the coating applied to the web of material 11 can be controlled independently of the speed of rotation of the applicator roll 7, by control of the speed of rotation of the rolls 1 and 6. The evenness of the coating applied to the web of material 11 is, as previously discussed, dependent upon the ratio between the speed of movement of the web of material 11 and the speed of rotation of the applicator roll 7. Because of the independent drive, the speed of rotation of the applicator roll 7 can be controlled independently of the speed of rotation of the rolls 1 and 6, and thus the apparatus can be used to apply to the web of material 11 an even coating of the coating material 4, having any desired coating weight.

I claim:

1. Apparatus for applying a coating to a web of material, the apparatus comprising:

a coating application system means for controlling the evenness of the coating applied to the web of material, and comprising:

a rotatable applicator roll, and a rotatable backing roll disposed adjacent said rotatable applicator roll to form a nip through which the web of material is passed;

a coating metering system means for controlling the weight of the coating applied to the web of material independently of the control of evenness by said coating application system, and comprising:

a rotatable gravure roll dipping into a bath of liquid coating material for picking up said liquid coating material, and a rotatable transfer roll that is in contact with and receives coating material from said gravure roll;

said gravure roll being operable to apply a predetermined amount of coating liquid material to said transfer roll;

said transfer roll being in contact with said applicator roll and operable to transfer liquid coating material to said coating applicator roll; and said rotatable coating applicator roll having drive means such that said applicator roller is driven in contact with said transfer roll for rotation in the same direction as said backing and transfer rolls and independently of the speed of rotation of said transfer and gravure rolls, whereby the metering system comprised of said gravure roll and said transfer roll is operable to control the speed of pick-up of coating material independently of the speed at which the web is coated by the application system comprised of said applicator roll and said backing roll so that wet, low weight coats are evenly applicable to the web.

* * * * *